US006790480B2

(12) United States Patent
Oki et al.

(10) Patent No.: US 6,790,480 B2
(45) Date of Patent: Sep. 14, 2004

(54) COATING APPARATUS

(75) Inventors: Kazuhiro Oki, Kanagawa (JP); Yoshinobu Katagiri, Kanagawa (JP); Masahiro Morikawa, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/201,734

(22) Filed: Jul. 24, 2002

(65) Prior Publication Data

US 2003/0033977 A1 Feb. 20, 2003

(30) Foreign Application Priority Data

Jul. 25, 2001 (JP) ..... 2001-224249

(51) Int. Cl.[7] ..... B05D 1/36; B05D 1/30; B05C 3/02

(52) U.S. Cl. ..... 427/402; 118/410; 118/411

(58) Field of Search ..... 285/148.18, 148.23; 118/410, 325, DIG. 2, DIG. 4, 419, 411, 612, 412; 239/600, 550; 427/356, 420, 358, 402, 128, 407.1, 409, 411; 425/466

(56) References Cited

U.S. PATENT DOCUMENTS 290,045 A * 12/1883 Hardy
2,761,419 A 9/1956 Mercier et al.
3,056,616 A * 10/1962 Jaros
6,547,159 B1 * 4/2003 Westby
6,548,760 B1 * 4/2003 Stout, Jr.

* cited by examiner

*Primary Examiner*—Brenda A. Lamb
(74) *Attorney, Agent, or Firm*—Birch, Stewart, Kolasch & Birch, LLP

(57) ABSTRACT

In a coating apparatus, a nozzle connects a feed pipe for feeding a coat solution to a manifold of a die with an opening of the manifold. The nozzle satisfies conditions: $1.5 \leqq B/A \leqq 5.0$ and $0.8 \leqq C/B \leqq 8.0$, when A is an equivalent diameter of an end of the nozzle to be connected with the tube, B is an equivalent diameter of another end of the nozzle to be connected with the opening, and C is a length of the nozzle. The coat solution fed from the feed pipe enters in the nozzle. In the nozzle, the coating solution diverges along with an inner wall of the nozzle to enter into the manifold. In the manifold the coating solution flows in a widthwise direction and flows out through a slit extending from the manifold to a lip of the die, such that a moving web is coated with the coating solution uniformly.

8 Claims, 11 Drawing Sheets

COATING APPARATUS

BACKGROUND OF THE INVENTION

1. Field of the Invention

The present invention relates to a coating apparatus for coating a coating solution on a web moving in a direction continuously, more particularly to a coating apparatus used for producing a photographic film, a photographic paper, an adhesive tape, a pressure selective paper, offset spring material, a battery and the like.

2. Description Related to the Prior Art

There is a coating apparatus for coating a coating solution on a continuous web or support. The coating apparatus includes a die having a manifold and a slit. In the manifold the coating solution is spread in a lengthwise direction of the manifold. Thereafter the coating solution enters from the manifold into the slit, and is discharged from the slit in a predetermined thickness. As the coating apparatus there are a slide bead coating type, an extrusion coating type, a curtain coating type and the like. For example, a structure of the slide bead coating type is disclosed in U.S. Pat. No. 2,761,419.

In the coating apparatus, it is necessary to regulate a discharging distribution of the coating solution in a lengthwise direction of the die, so as to maintain a uniformity of a flow. As a method of such regulation, there is a central feed type in which the coating solution is supplied to the central part of the manifold. In the central feed type, a coat hanger type is used usually. However, in the central feed type, an influence of a dynamic pressure becomes large, for example, when the amount of the coating solution to be fed becomes larger or the coating solution has a low viscosity. In this case, the amount of the coating solution applied on the web becomes remarkably uneven. As described in Japanese Patent-Laid Open Publication No. 6-335633, the coating solution is fed in the manifold from a side thereof so as to make the influence of the dynamic pressure smaller and the amount of discharging the coating solution constant.

In order to feed a coating solution in the manifold, a coating apparatus is provided with a connecting pipe which connects a feed metal pipe or hose with the manifold. For example, S. F. Kistler and P. M. Schweizer describes in "Liquid Film Coating" (CHAPMAN&HALL, 1977) about feeding the coating solution from each of the central part and a side of the feed type. However, S. F. Kistler et al does not describe concrete shapes of the connecting pipe. The concrete shape of the connecting pipe used in the central feed type is disclosed in U.S. Pat. No. 2,761,419.

Preferably the coating solution has no temperature distribution in order to make the amount of discharging uniform. However, as the connecting pipe has a complex shape, it is difficult to keep a temperature of the connecting pipe constant. Therefore, the temperature easily varies, which causes the discharging distribution of the coating solution in the lengthwise direction to become uneven.

There are little materials explained about the side-feed type in which the feed pipe or hose is connected with the manifold. For example, Yun-Han Chang made a speech of title "Experimental Observation on Entrance Flow Inside Extrusion Dies" in AIChE, 1996 SPRING NATIONAL MEETING (Feb. 25–29, 1996. in New Orleans USA). However, in this speech Yun-Hang Chang considers only about the flow in a sudden enlargement that generates by connecting the manifold through the connecting pipe with the tube which has different size from the manifold. However, in the side feed type, the manifold and the feed pipe are often different in size and shape. Usually, the manifold has larger size than the feed pipe. In this case the connecting pipe has an enlarged shape, and a bent pipe is used for a space saving. Inside the bent pipe, eddies generate and a pressure distribution becomes large. Accordingly, a pressure loss in the connecting pipe becomes extremely larger, which has a large influence on the discharging distribution of the coating solution in the lengthwise direction of the slit.

SUMMARY OF THE INVENTION

An object of the present invention is to provide a coating apparatus which can keep uniformly a discharging distribution of the coating solution to apply a web in a lengthwise direction of the slit.

Another object of the present invention is to provide a coating apparatus in which the coating solution can be stably fed from a side of the manifold without stirring a flow of the coating solution.

Still another object of the present invention is to provide a connecting member for stably feeding a solution from a side of the manifold without stirring a flow of the coating solution.

In order to achieve the object and the other object, a coating apparatus having a manifold provided with an entrance opening includes a divergent connecting member for connecting the entrance opening and a feed pipe (including hose) for feeding the coating solution to the manifold. The divergent connecting member has a size satisfying $1.5 \leqq (B/A) \leqq 5.0$ and $0.8 \leqq (C/B) \leqq 8.0$, when A, B and C are an equivalent diameter of an end of the divergent connecting member for connecting the feed pipe, an equivalent diameter of an end of the divergent connecting member for connecting to the entrance opening, and a length of the enlarging part respectively.

The manifold and the divergent connecting member are connected with each other such that bottoms of them are in alignment. Further, the feed pipe is connected to the divergent connecting member from a lower side of thereof, and inclined backwards from the divergent connecting member. Furthermore, in the feed pipe a static mixer is provided close to the divergent connecting member.

According to the coating apparatus of the present invention, the coating solution is fed without a flow being stirred, and the discharging distribution of the coating solution to be discharged on a web is regulated.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
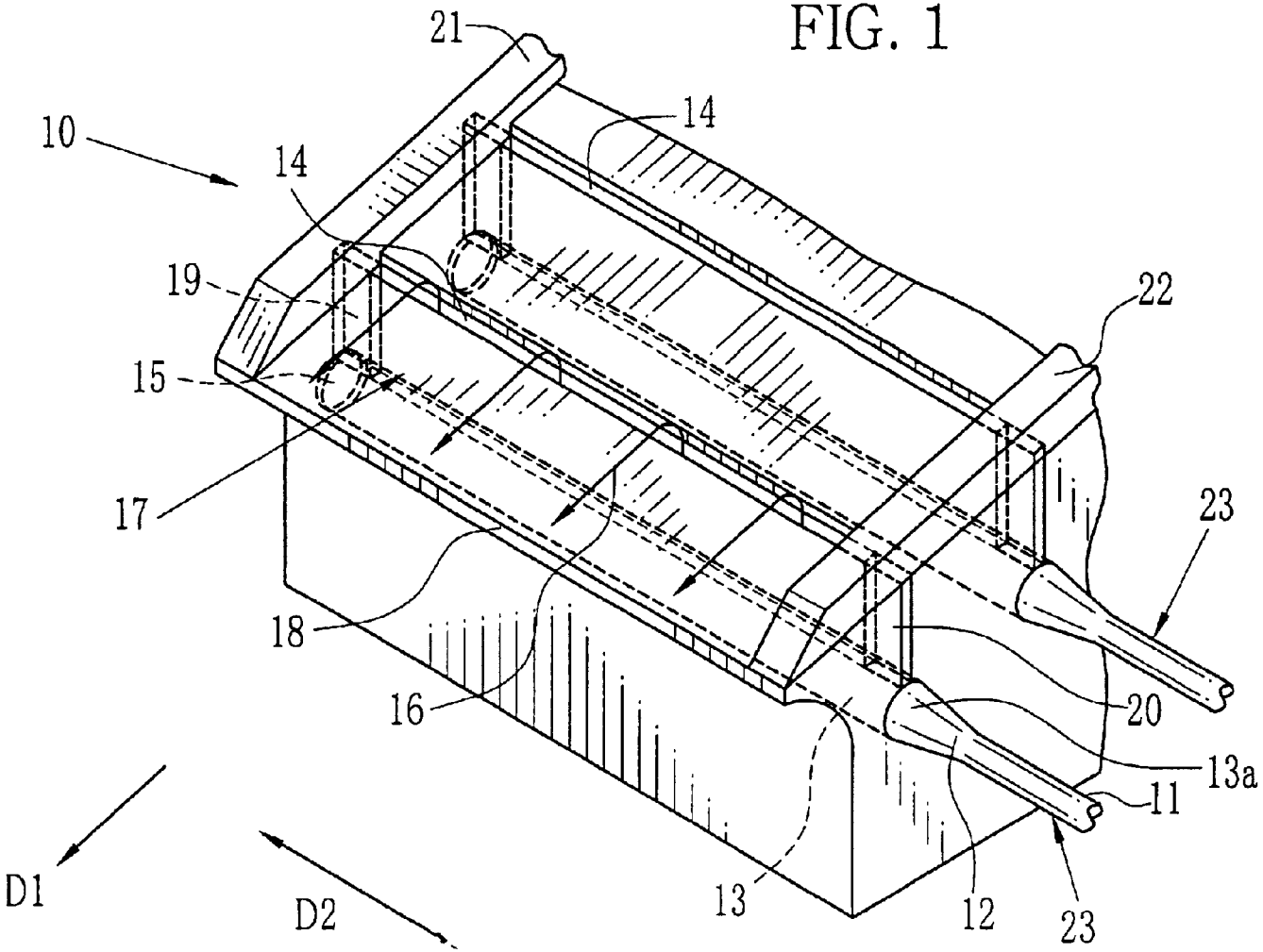
FIG. 1 is a partial perspective view of a coating apparatus including a solution feed pipe line of the first embodiment of the present invention.

As shown in FIG. 1, a bead type coating die or hopper (hereinafter die) 10 includes a manifold 13, a slit 14, a manifold stopper 15, a slide face 17, a lip 18, slit length regulators 19, 20 and guide plates 21, 22. The manifold 13 has an inlet opening 13*a* on a side thereof, and is connected through a divergent connecting pipe or divergent nozzle (hereinafter nozzle) 12 with a feed pipe 11, such as a metallic pipe or a hose. In another side of the manifold the manifold stopper 15 is fixedly fitted.

A coating solution feed system (not shown) feeds a coating solution 16 through the feed pipe 11, the nozzle 12, and the inlet opening 13*a* into the manifold 13. The coating solution 16 is prevented by the manifold stopper 15 from flowing out from a side of the die 10. Then the coating solution 16 enters into the slot 14, and flows out from the slit 14 in outside of the die 10. Thereafter, the coating solution 16 slides on the slide face 17 to reach the lip 18, and is applied on a web 9 moving by a roller 8.

The slit 14 is formed so as to have a predetermined width in a coat direction D1. Accordingly, after flowing out from the slit 14, the coating solution 16 applied to the web 9 has a predetermined wet thickness. Note that the die 10 is supplied with the coating solution from a right side, but may be supplied from a left side. In this case, the manifold stopper 15 is set in the inlet opening 13*a* on the right side of the die 10.

In the slit 14, the slit length regulators 19, 20 are inserted in order to regulate a length of the coating solution 16 along a widthwise direction D2. The slit length regulators 19, 20 are removably attached in the slit 14. The length of the slit 14 can be adjusted as described in Japanese Patent-Laid Open Publication No. 6-335633. Further, the slide face 17 is provided with guide plates 21, 22 for determining a width of the coating solution 16 along the direction D2. Note that materials for manifold 13, the manifold stopper, the slide face 17, the slit length regulators 19, 20, and the guide plates 21, 22 may be metal, plastics, rubber and wood.

Figure 1A:
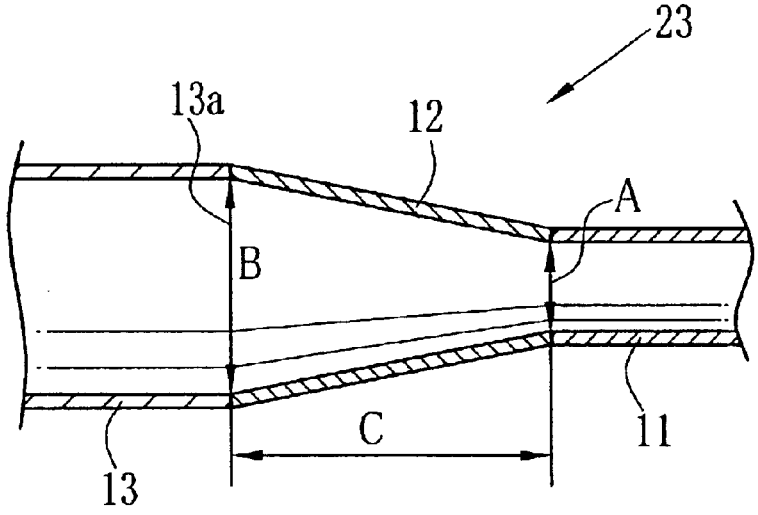
FIG. 1A is a partial sectional view of the solution feed pipe line of the FIG. 1.
Figure 1B:
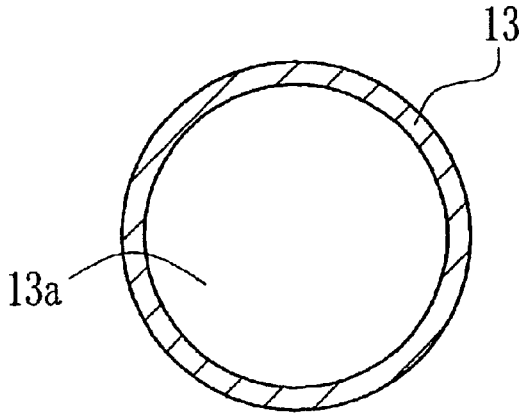
FIG. 1B is a sectional view along a line IB—IB in FIG. 1A.

In FIG. 1A, characters A, B and C are an equivalent diameter of the nozzle 12 for connecting the feed pipe 11, an equivalent diameter of an end for connecting to the inlet opening 13*a*, and a length of the extending part respectively. When a ratio of the equivalent diameter B to the equivalent diameter A is small, the coating solution flows without being stirred. However, the equivalent diameter B is usually larger than the equivalent diameter A. When the diameter of the feed pipe 11 becomes larger, the coating solution does not flow smoothly, which causes the bad influence on the discharging distribution. In order to feed the coating solution 16 from the feed pipe 11 into the manifold 13 without being stirred, the nozzle 12 has a shape satisfying conditions: $1.5 \leqq (B/A) \leqq 5.0$ and $0.8 \leqq (C/B) \leqq 8.0$. Note that the equivalent diameter means a hydrostatical equivalent diameter, and is determined as (four times of size of the cross section)/(wet length of the cross section). As shown in FIG. 1B, the inlet opening 13*a* has a circular shape.

In the embodiment above, the die 10 may be used for coating a coating solution having only a single layer. Further, the number of the feed pipe lines may be larger than three in order to increase an efficiency of coating the coating solution 16. Furthermore the die 10 may be also a curtain type coating die or the like. The coating apparatus is used for example for producing a photographic film, a photographic paper, a magnetic recording tape, an adhesive tape, a pressure sensitive paper, an offset printing material, a battery and the like. Further, the nozzle 12 of the present invention may be used in an film base production apparatus for producing a film from a dope.

Figure 2:
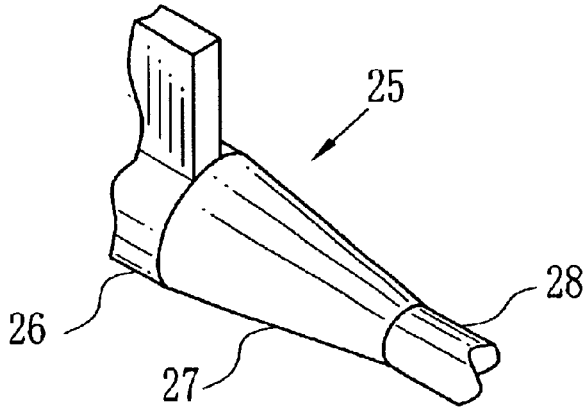
FIG. 2 is a partial perspective view of a solution feed pipe line of the second embodiment of the present invention.
Figure 2A:
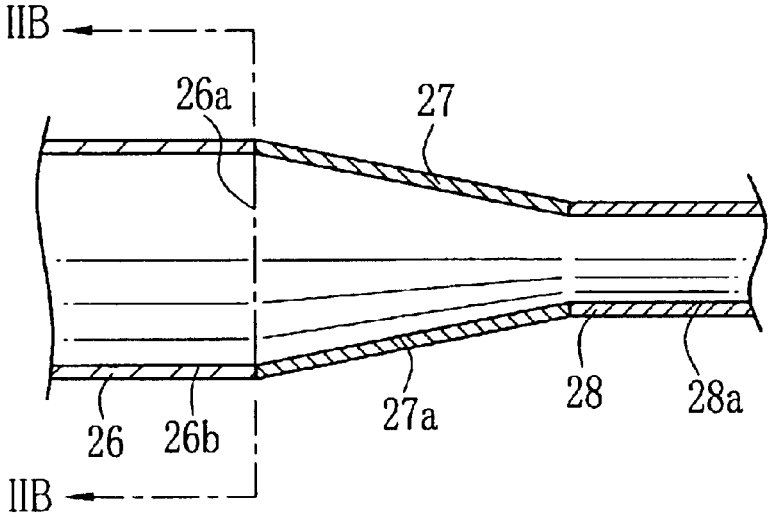
FIG. 2A is a partial sectional view of the solution feed pipe line of FIG. 2.
Figure 2B:
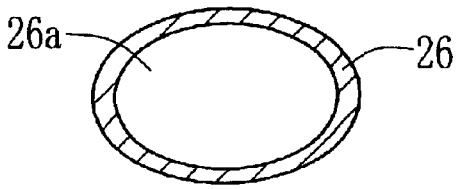
FIG. 2B is a sectional view along a line IIB—IIB in FIG. 2A.

In FIG. 2, the solution feed pipe line 25 is a second embodiment of the present invention, and constituted of a manifold 26, a nozzle (divergent connecting pipe) 27 and a feed pipe 28. In FIG. 2A, the nozzle 27 extends from the end of the feed pipe 28 to the manifold 26. As shown in FIG. 2B, an opening 26*a* of the manifold 26 has an elliptical shape.

Figure 3:
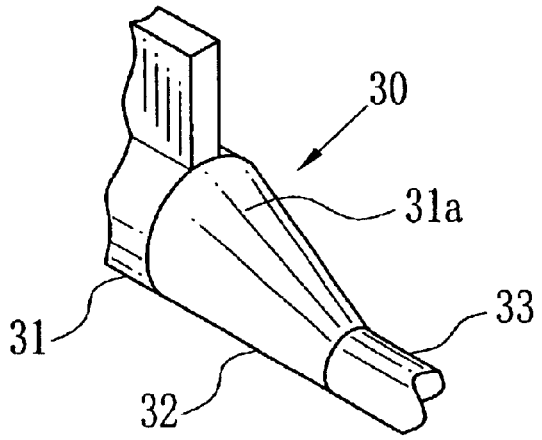
FIG. 3 is a partial perspective view of a solution feed pipe line of the second embodiment of the present invention.
Figure 3A:
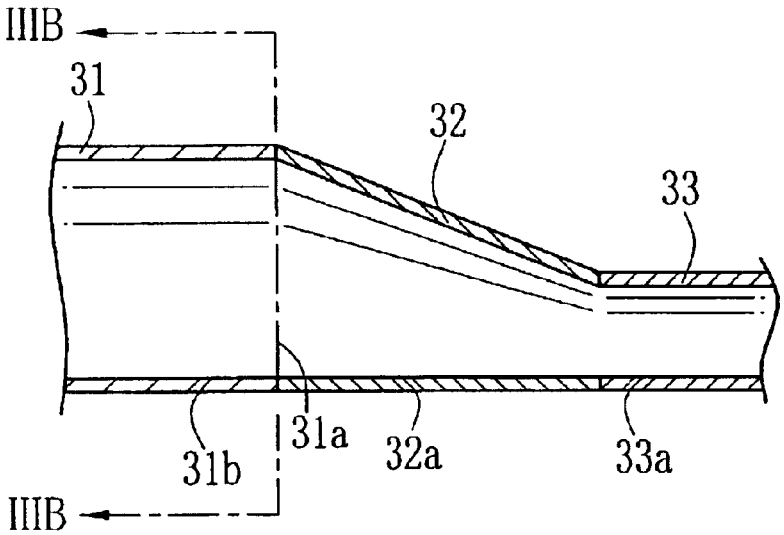
FIG. 3A is a partial sectional view of the solution feed pipe line of FIG. 3.
Figure 3B:
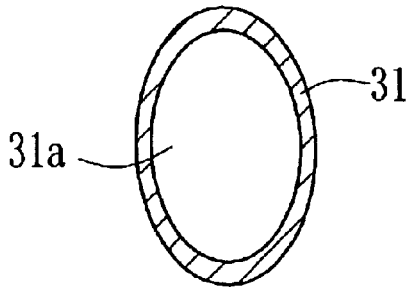
FIG. 3B is a sectional view along a line IIIB—IIIB in FIG. 3A.

In FIG. 3, the solution feed pipe line 30 is a third embodiment of the present invention, and constituted of a manifold 31, a nozzle (divergent connecting pipe) 32 and a feed pipe 33. In FIG. 3A, the manifold 31, the nozzle 32 and the feed pipe 33 are connected such that respective bottom 31*a*, 32*a*, 33*a* of them are in alignment. In this structure, the coating solution can be supplied from the feed pipe 33 into the manifold 31 without being stirred. Further, a brush is easily moved for cleaning insides of the manifold 31 and the nozzle 32. As shown in FIG. 3B, an inlet opening 31*a* of the manifold 31 has an elliptical shape.

Figure 4:
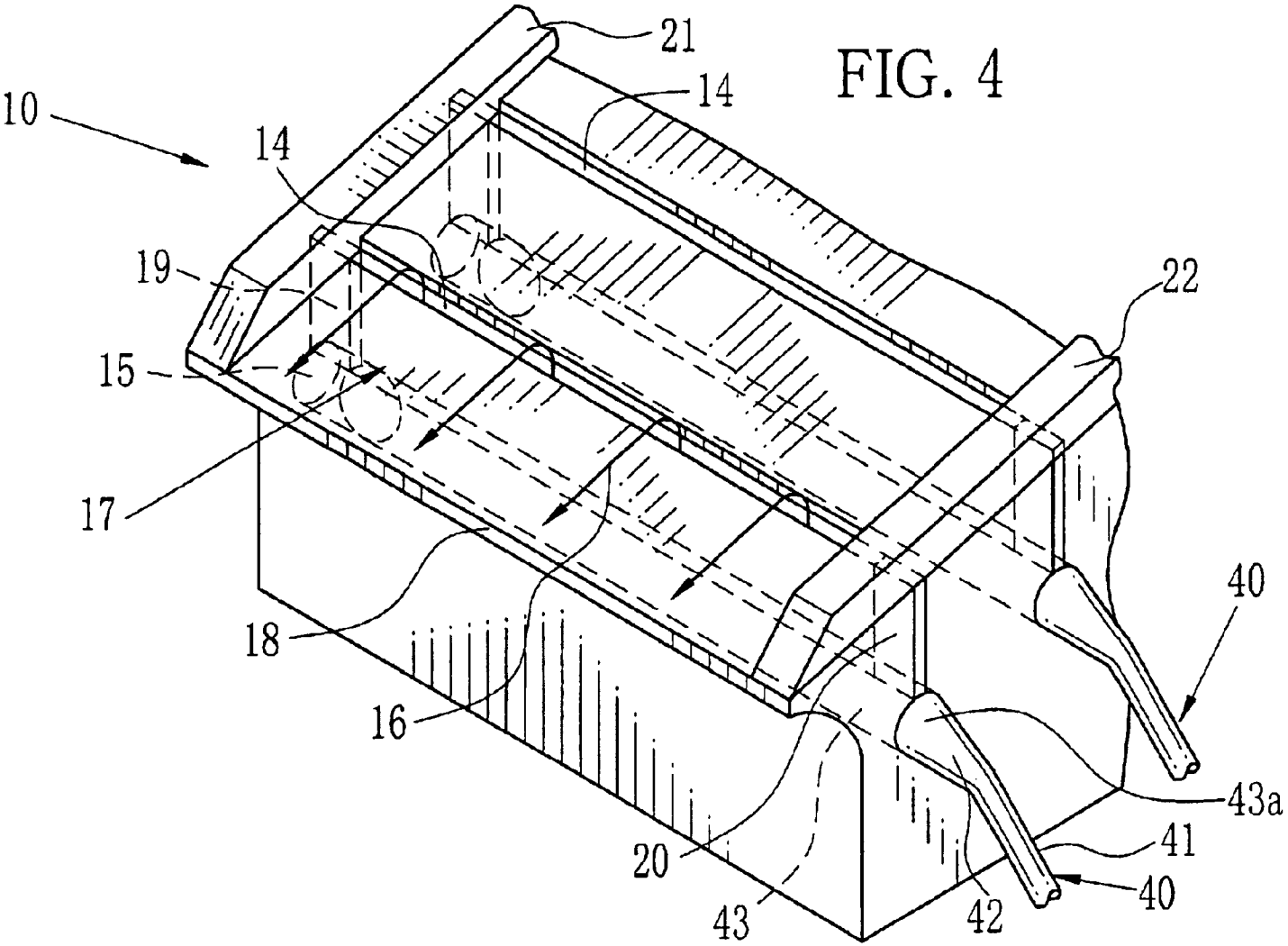
FIG. 4 is a partial perspective view of a coating apparatus including a solution feed pipe line of the forth embodiment of the present invention.
Figure 4A:
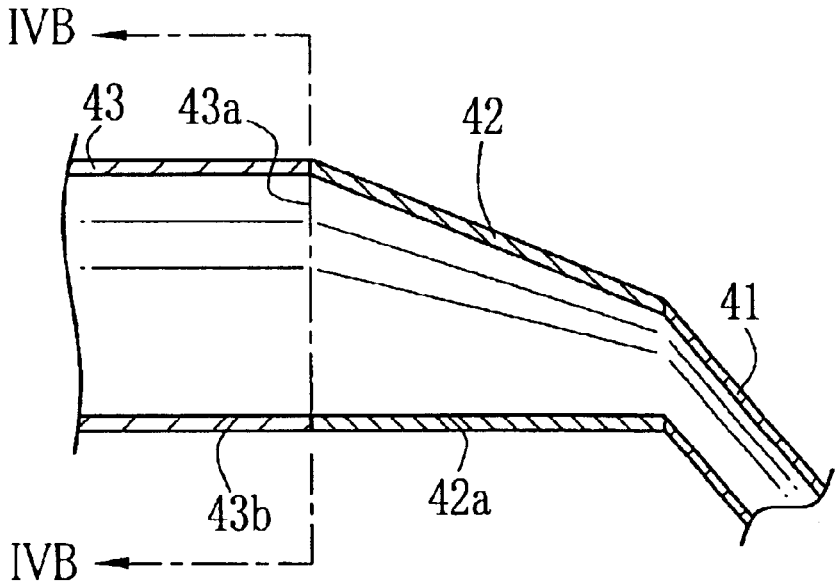
FIG. 4A is a partial sectional view of the solution feed pipe line of FIG. 4.
Figure 4B:
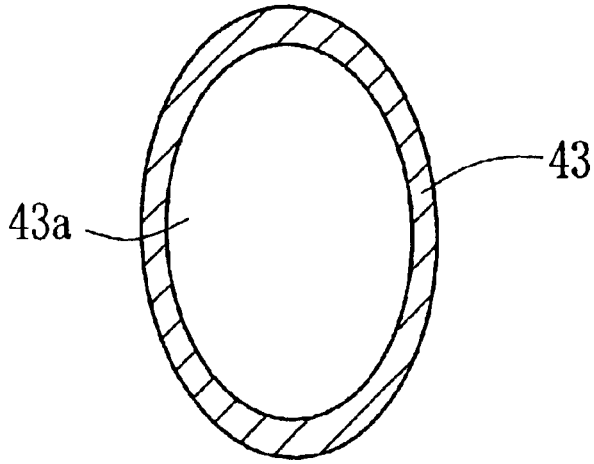
FIG. 4B is a sectional vies along a line IVB—IVB in FIG. 4A.

As shown in FIG. 4, the die 10 is provided with a solution feed pipe line 40. In the solution feed pipe line 40 the feed pipe 41 is connected to the nozzle (divergent connecting pipe) 42 from the lower side of the nozzle 42. As shown in FIG. 4A, respective bottoms 41*a*, 42*a*, 43*a* of the manifold 41, the nozzle 42 and the feed pipe 43 are in alignment. In this structure, the coating solution can be fed from the feed pipe 43 into the manifold 41 without being stirred. Further, the brush is easily moved for cleaning insides of the manifold 41 and the nozzle 42. As shown in FIG. 4B, an inlet opening 43*a* of the manifold 43 has a circular shape.

Figure 5:
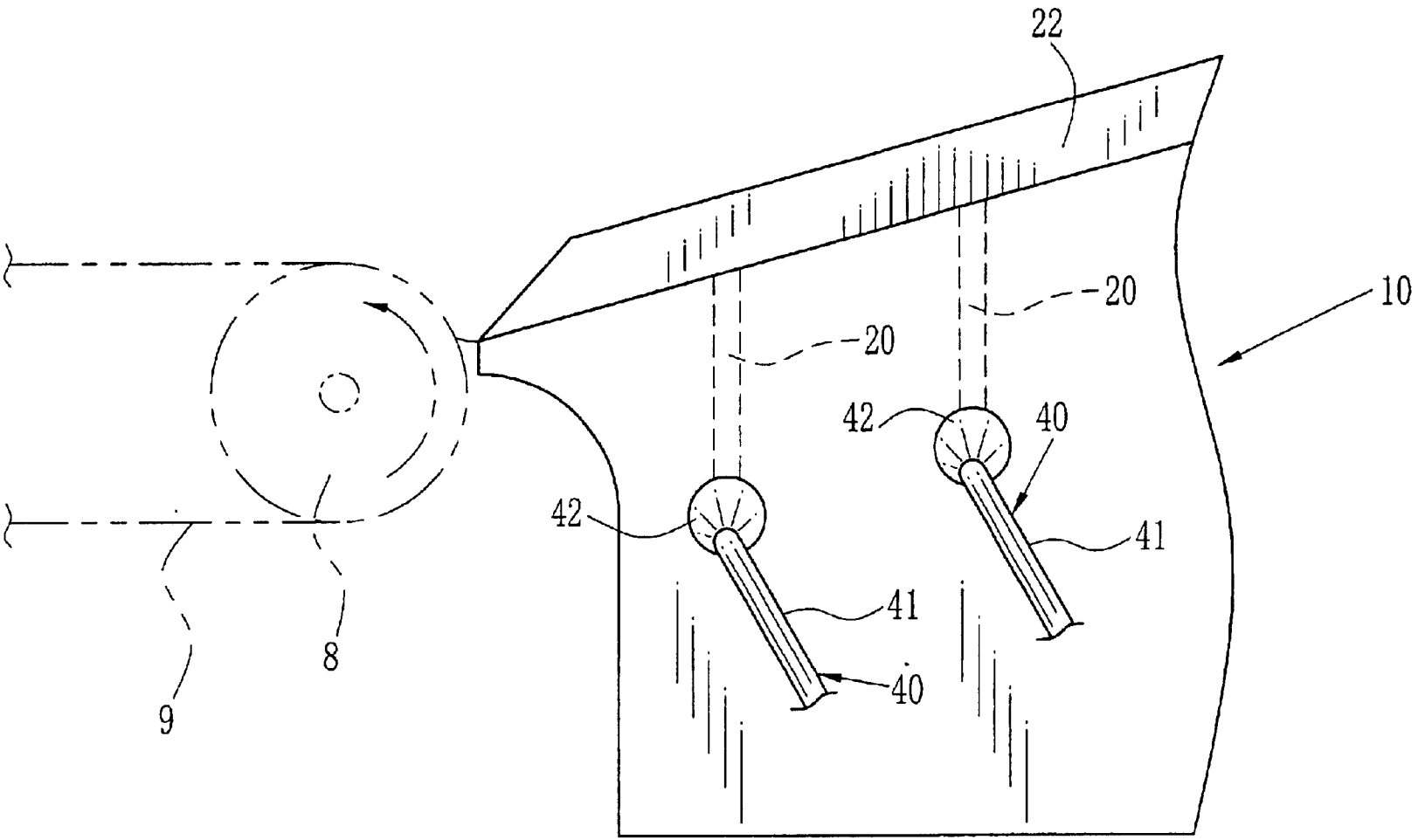
FIG. 5 is a side view of a coating apparatus including a solution feed pipe line.

Further, as shown in FIG. 5, the feed pipe 41 is preferably attached to the nozzle 42 from a back side of the die 10.

Figure 6:
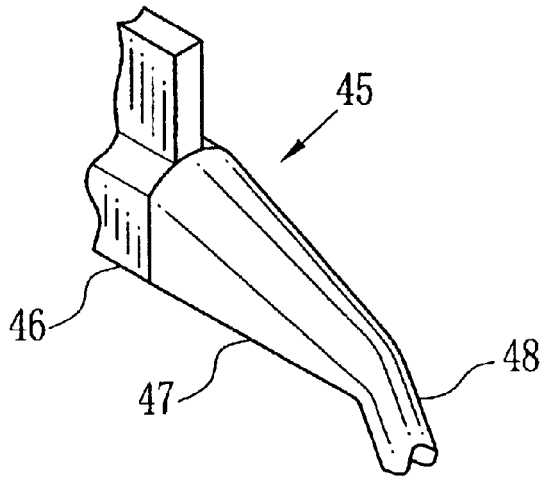
FIG. 6 is a partial perspective view of a solution feed pipe line of the fifth embodiment of the present invention.
Figure 6A:
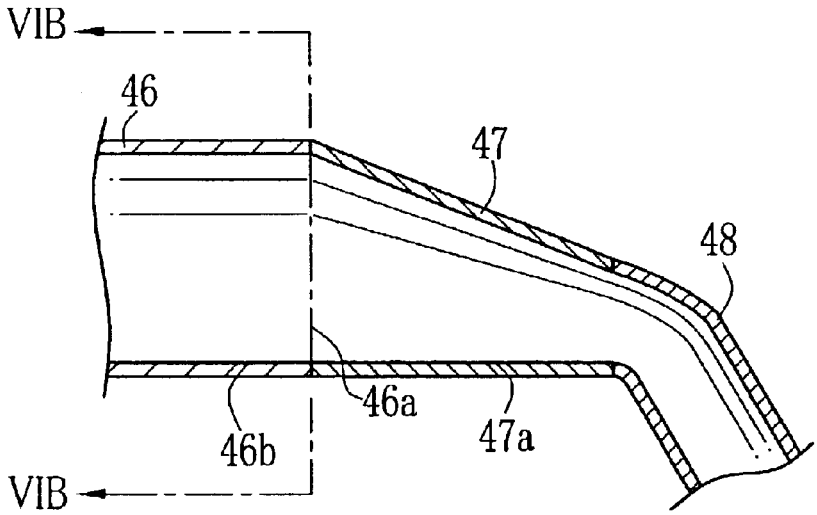
FIG. 6A is a partial sectional view of the solution feed pipe line of FIG. 6.
Figure 6B:
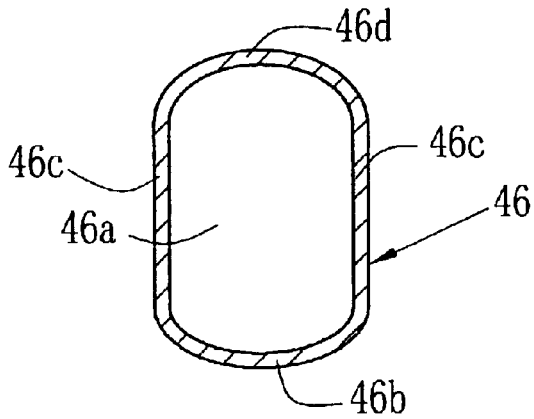
FIG. 6B is a sectional vies along a line VIB—VIB in FIG. 6A.

In FIG. 6, a solution feed pipe line 45 is constructed of a manifold 46, a nozzle (divergent connecting pipe) 47 and a feed pipe 48. As shown in FIG. 5A, the manifold 46 and the nozzle 47 are connected such that respective bottoms 46*a*, 46*b* thereof are in alignment. The feed pipe 48 is connected to the nozzle 47 so as to form a gentle curve. Accordingly, the coating solution can be fed from the feed pipe 48 into the manifold 46 without being stirred. Further, in FIG. 6B, the manifold 46 is constituted of walls 46*b*, 46*c*, 46*d*. The walls 46*b* and 46*d* is curved and a radius of curvature of the wall 46*b* is larger than that of the wall 46*d*.

In the present invention, the structure of the manifold is not restricted in above description. For example, a cross section of the upper and bottom walls of the manifold is curved so as to have the same radius of curvature. Further, the radius of the upper wall may be larger than that of the bottom wall. Furthermore the walls 46*c* may be curved.

Figure 7:
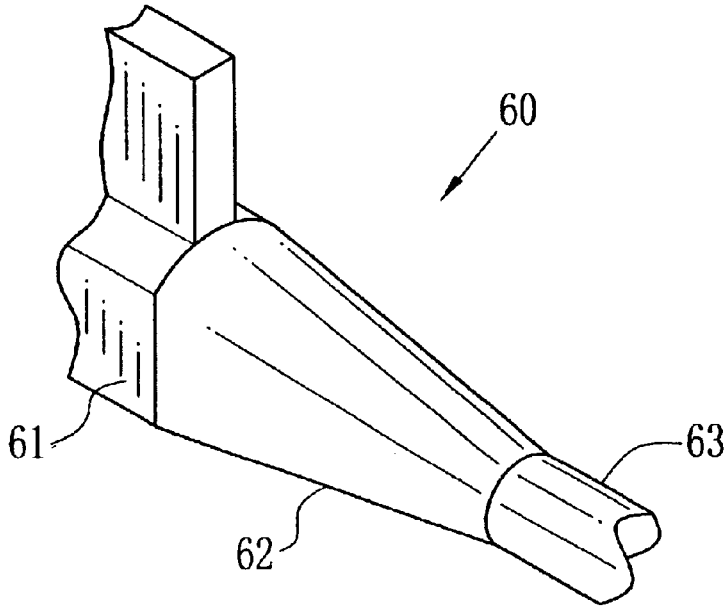
FIG. 7 is a partial perspective view of a solution feed pipe line of the sixth embodiment of the present invention.

In FIG. 7, in a solution feed pipe line 60 a nozzle 62 is attached to the manifold 61. A bottom of the nozzle 62 is inclined to the bottom of the manifold 61, which is different from FIG. 6B.

Figure 8:
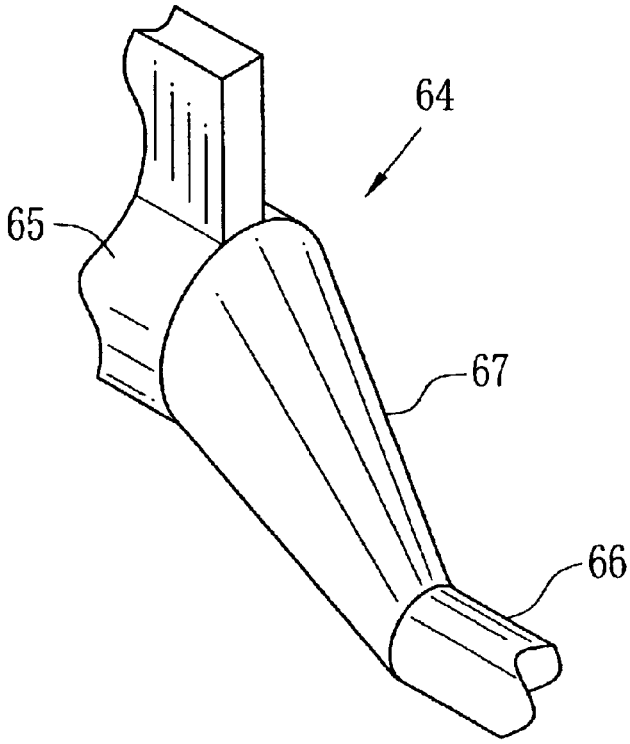
FIG. 8 is a partial perspective view of a solution feed pipe line of the seventh embodiment of the present invention.

In FIG. 8, the solution feed pipe line 64 is constructed of a cylindrical manifold 65, a tube 66 and a nozzle 67. The manifold 65 is attached to the nozzle 67 upwards from the feed pipe 66. In this case, a cross section of the nozzle 67 is an elliptical shape. Thus, the coating solution is supplied for the manifold 65 without being stirred.

Figure 9:
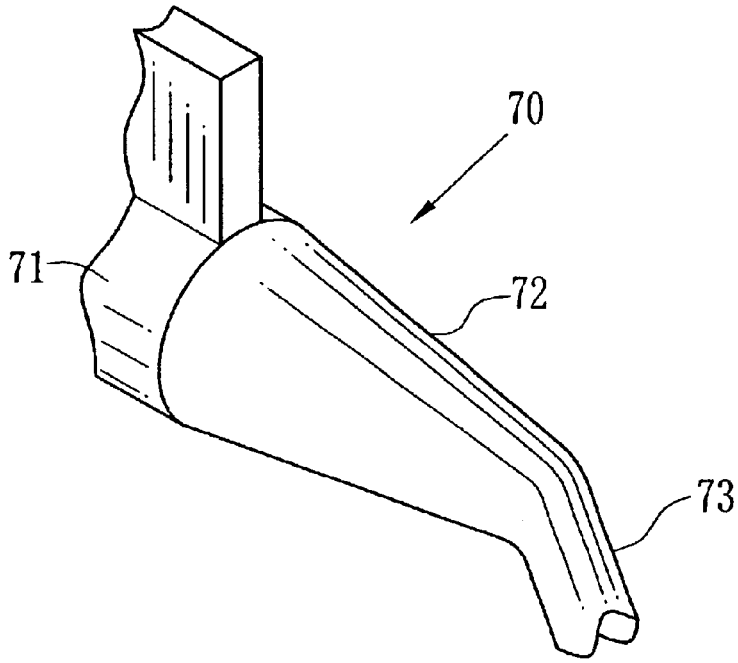
FIG. 9 is a partial perspective view of a solution feed pipe line of the eighth embodiment of the present invention.
Figure 10:
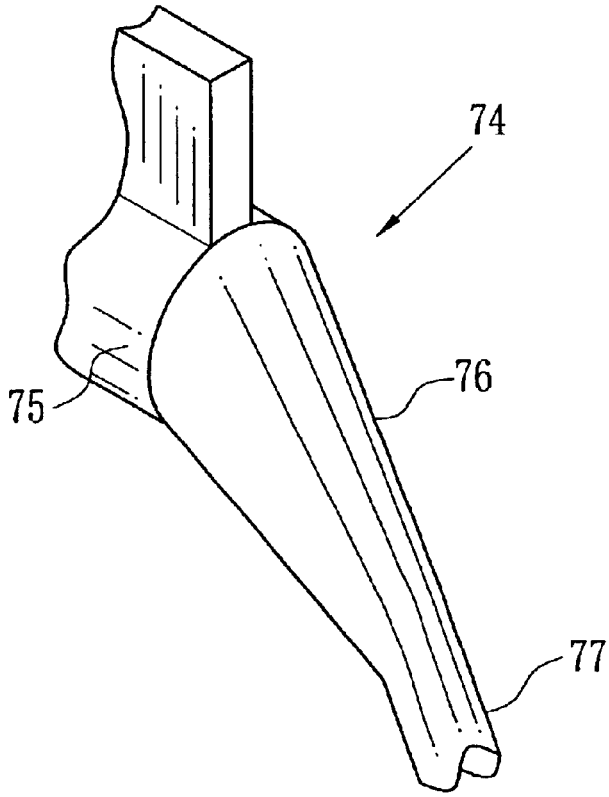
FIG. 10 is a partial perspective view of a solution feed pipe line of the ninth embodiment of the present invention.

In FIG. 9, in the solution feed pipe line 70, a nozzle 72 connects a manifold 71 and a feed pipe 73. The tube 73 is attached to the nozzle 72 from a lower side. As shown in FIG. 10, in a solution feed pipe line 74, a nozzle 76 is attached to a manifold 75 from a lower side, and a tube 77 is attached to the nozzle 76 from a lower side.

In the present invention, a positional relation of the feed pipe and the manifold is not restricted in the above embodiments. Further, the feed pipe is attached to an adequate position of the nozzle.

Figure 11:
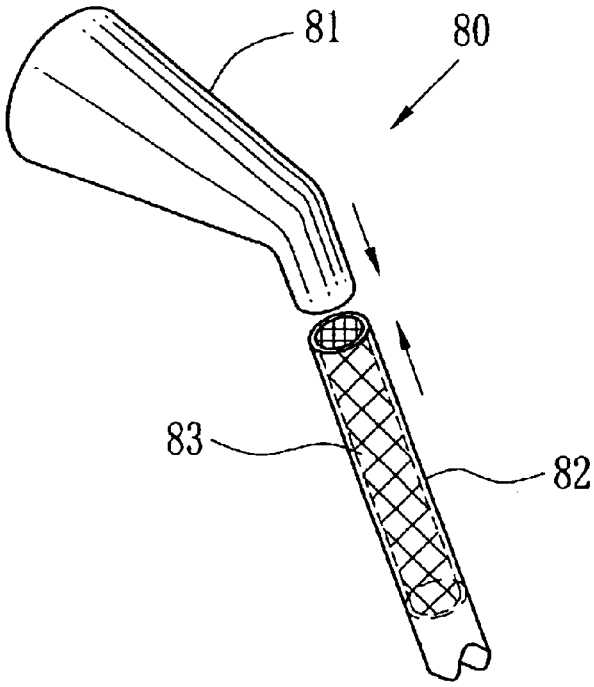
FIG. 11 is a partial perspective view of a solution feed pipe line of the tenth embodiment of the present invention.
Figure 12:
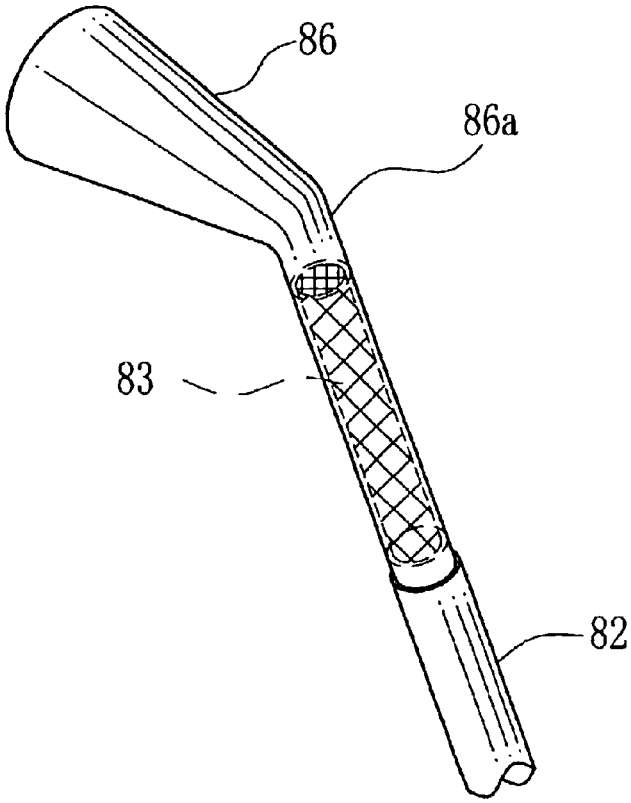
FIG. 12 is a partial perspective view of a solution feed pipe line of the eleventh embodiment of the present invention.

In FIG. 11, a solution feed pipe line 80 includes a nozzle 81 and a feed pipe 82. In the feed pipe 82, a static mixer (or motionless mixer) 83 is provided in order to make a thermo distribution of the coating solution even by coating the coating solution. Further, in FIG. 12, a pipe portion 86*a* is integrally formed with a nozzle 86, and in the pipe portion 86*a* the static mixer 83 is provided.

About the static mixer 83, Harnby describes in "Ekitai-Kongou-Gijutsu (Fluid Mixing)" (translation by Koji TAKAHASHI, NIKKAN KOGYO PRESS). Further, a shape of the static mixer 83 is not restricted in the above description. For example, an olyphis type of the static mixer may be used when it is provided in the pipe or the pipe portion of the nozzle, and the necessary efficiency of mixing is expected.

There are several sorts of the coating solution used in the present invention. For example, there are sorts of the coating solution that are used for forming a photosensitive emulsion layer, a first coating layer, a protective layer, a back layer and the like in a photosensitive material. Further, there are sorts thereof that are used for forming a magnetic layer, first coating layer, a lubricant layer, a protective layer, a back layer and the like in a magnetic recording material. There are further sorts that are used for forming a resin layer, a matt layer and a layer containing micro capsules in a pressure sensitive material, thermosensitive material and the like. Each sort of the coating solutions contains several components in accordance with use thereof. Note that the sorts of the coating solution used in the present invention are not restricted in the above description.

As the web used in the present invention is formed of paper, plastic film, metal, resin coated paper, synthesized paper and the like. The plastic film is formed of polyolefins (for example, polyethylene, polypropylene and the like), vinylpolymers (for example, polyvinylacetate, polyvinylchloride, polystyrene and the like). Further, there are for example, polyamides (6,6-nylon, 6-nylon and the like), polyesters (polyethylenetelephthalate, polyethylene-2, 6-naphthalate and the like), cellulose acetates (cellulosetriacetate, cellulosediacetate and the like), and polycarbonates. However, materials for the plastic film are not restricted in them. As resins used for the resin-coated paper, there are polyolefins (for example, polyethylene) and the like. However the resins are not restricted in them. Further, as a metal web there is, for example, an aluminum web.

Experiments 1 and 2 carried out according to the above embodiments are explained now. In Experiments 1 and 2, the coating solution is fed to coat the web with the die 10 in FIG. 4, and the discharging distribution of the coating solution is measured in the widthwise direction.

[Experiment 1]

EXAMPLES 1–9

Examples 1–9 each are formed to have seven layers which simultaneously coat the web. According to the nozzle 42, (equivalent diameter in the cross section B)/(equivalent diameter in the cross section A) is set between 1.5 and 5.0, and (length C)/(equivalent diameter in the cross section B) is set between 0.8 and 8.0. As the web, polyester coating paper is used that has a thickness of 220 $\mu$m, and width of 1.5 m. As the coating solution, alkali processed gelatin solution at 10% is used. As the surface active agent, di-2-ethylhexyl-$\alpha$-sodium sulfosuccinate is added in the coating solution. As the lubricants, polystyrene sulfuric salt is added such that a viscosity of the coating solution is 50 mPa·s. The discharging distribution of the coating solution to be coated is 0.6 ml/(cm·s) in one layer, and a velocity for coating is 200 m/min.

Comparisons 1–8

Comparisons 1–8 are formed as same as the Examples 1–9. However, the nozzle does not satisfy at least one of the conditions that (equivalent diameter in the cross section B)/(equivalent diameter in the cross section A) is set between 1.5 and 5.0, and (length C)/(equivalent diameter in the cross section B) is set between 0.8 and 8.0.

(Evaluation)

The coating solution on the web is dried to form a layer. A thickness of the layer is measured at thirty positions, and the discharging distribution is obtained on the base of data according to the thickness. When the discharging distribution is not more than 2%, the layer is evaluated as uniform, and when the discharging distribution is more than 2%, the layer is estimated as ununiform.

TABLE 1

| | B/A | C/B | Distribution | Evaluation |
|---|---|---|---|---|
| Example 1 | 1.5 | 0.8 | 1.7 | Uniform |
| Example 2 | 1.5 | 8.0 | 1.2 | Uniform |
| Example 3 | 3.0 | 0.8 | 1.9 | Uniform |
| Example 4 | 3.0 | 1.5 | 1.8 | Uniform |
| Example 5 | 5.0 | 0.8 | 2.0 | Uniform |
| Example 6 | 5.0 | 8.0 | 1.5 | Uniform |
| Example 7 | 1.5 | 3.0 | 1.6 | Uniform |
| Example 8 | 3.0 | 3.0 | 1.7 | Uniform |
| Example 9 | 5.0 | 3.0 | 1.8 | Uniform |
| Comparison 1 | 1.0 | 0.6 | 3.5 | Ununiform |
| Comparison 2 | 1.0 | 0.8 | 3.0 | Ununiform |
| Comparison 3 | 1.0 | 8.0 | 2.5 | Ununiform |
| Comparison 4 | 6.0 | 0.6 | 4.0 | Ununiform |
| Comparison 5 | 6.0 | 0.8 | 3.5 | Ununiform |
| Comparison 6 | 6.0 | 8.0 | 3.0 | Ununiform |
| Comparison 7 | 3.0 | 0.6 | 3.7 | Ununiform |
| Comparison 8 | 3.0 | 9.0 | 2.8 | Ununiform |

As shown in Table 1, according to the nozzle, the ratio C/B is set between 0.8 and 8.0, and the ratio B/A is set between 1.5 and 5.0.

Further, the present invention is not restricted in 10 forming seven layers. For example, when the coating solutions are coated so as to form fifteen layers on the web with the die of the present invention, the discharging distribution of the coating solution is also less than 2%.

[Experiment 2]

EXAMPLES 10 and 11

Examples 10 and 11 are formed under same conditions as Examples 1 and 2, except of providing a static mixer in a nozzle.

TABLE 2

| | B/A | C/B | Distribution | Estimation |
|---|---|---|---|---|
| Example 10 | 1.5 | 0.8 | 1.4 | Uniform |
| Example 11 | 1.5 | 8.0 | 0.8 | Uniform |

As shown in Table 2, the amount of discharging of the coating solution is decreased about 0.3%. Therefore the coating solution is more uniformly fed to coat the web.

The present invention is not restricted in the above embodiments, and applied to an apparatus for manufacturing a film from a solution.

Various changes and modifications are possible in the present invention and may be understood to be within the present invention.

What is claimed is:

1. A coating apparatus for discharging from a slit a coating solution to form a layer on a moving web, said slit extending from a manifold of a die, comprising:

an inlet opening provided on an end of said manifold;

a feed pipe for supplying said coat solution to said manifold; and a divergent connecting member disposed so as to connect said inlet opening and said feed pipe, said divergent connecting member satisfying $1.5 \leqq B/A \leqq 5.0$, and $0.8 \leqq C/B \leqq 8.0$, wherein A is an equivalent diameter of a first end of said divergent connecting member in a side to be connected with said feed pipe, B is an equivalent diameter of a second end of said divergent connecting member in a side to be connected with said inlet opening, and C is a length of said divergent connecting member.

2. A coating apparatus according to claim 1, wherein said divergent connecting member is a divergent connecting pipe.

3. A coating apparatus according to claim 2, wherein said manifold and said divergent connecting pipe are connected such that a bottom of said manifold and a bottom of said divergent connecting pipe are in alignment.

4. A coating apparatus according to claim 3, wherein said feed pipe is connected to a lower portion of said divergent connecting pipe.

5. A coating apparatus according to claim 4, wherein said feed pipe is backwardly inclined against said divergent connecting pipe.

6. A coating apparatus according to claim 2, wherein a static mixer is provided in said feed pipe at a position close to said one divergent connecting pipe.

7. A coating apparatus according to claim 6, further comprising at least one set having another manifold, another divergent connecting pipe and another feed pipe, to form multi-layers on said web.

8. A method for discharging a coating solution from a slit to form a layer on a moving web, said slit extending from a manifold of a die, comprising:

providing an inlet opening on an end of said manifold;

supplying said coat solution through a feed pipe to said manifold; and connecting said inlet opening and said feed pipe with a divergent connecting member, said divergent connecting member satisfying $1.5 \leqq B/A \leqq 5.0$, and $0.8 \leqq C/B \leqq 8.0$, wherein A is an equivalent diameter of a first end of said divergent connecting member in a side to be connected with said feed pipe, B is an equivalent diameter of a second end of said divergent connecting member in a side to be connected with said inlet opening, and C is a length of said divergent connecting member.

* * * * *